US008171944B1

(12) United States Patent
Hsu

(10) Patent No.: US 8,171,944 B1
(45) Date of Patent: May 8, 2012

(54) HAIR RETAINER

(76) Inventor: Shih-Ling Hsu, Tainan (TW)

( * ) Notice: Subject to any disclaimer, the term of this patent is extended or adjusted under 35 U.S.C. 154(b) by 0 days.

(21) Appl. No.: 12/987,197

(22) Filed: Jan. 10, 2011

(51) Int. Cl.
*A45D 8/22* (2006.01)
*A45D 8/00* (2006.01)

(52) U.S. Cl. ..... 132/278; 132/273

(58) Field of Classification Search ..... 132/278, 132/273, 276–277, 279, 280–284, 126, 128
See application file for complete search history.

(56) References Cited

U.S. PATENT DOCUMENTS 1,844,644 A * 2/1932 Eisler ..... 132/246
2,832,358 A * 4/1958 Chambers ..... 132/273
3,542,041 A * 11/1970 Mercorella ..... 132/275
5,566,690 A * 10/1996 Shih-Ming ..... 132/276
5,826,593 A * 10/1998 Haubrich ..... 132/128
D636,935 S * 4/2011 Pilan ..... D28/41
D636,936 S * 4/2011 Tsai ..... D28/42
2004/0163660 A1* 8/2004 Kellmann ..... 132/201

* cited by examiner

*Primary Examiner* — Robyn Doan
(74) *Attorney, Agent, or Firm* — Alan Kamrath; Kamrath IP Lawfirm, PA

(57) ABSTRACT

A hair retainer includes an annular body having a receiving through-hole through which a section of hair of a user is adapted to be extended. The annular body is flexible, bendable, and twistable so as to so create a variety of hair styles. Two clamping frames extend outwardly from first and second end portions of the annular body respectively. A plurality of teeth projects from an inner end of each clamping frame and extends toward an outer end of each clamping frame. A hair clipping space is defined between the plurality of teeth and one of the two clamping frames for further retaining the variety of hair styles in place.

3 Claims, 9 Drawing Sheets

HAIR RETAINER

BACKGROUND OF THE INVENTION

1. Field of the Invention

The present invention relates to a hair retainer and, more particularly, to a hair styling device for both styling the hair and securely retaining the hair style in place.

2. Description of the Related Art

A type of hair styling device includes an annular body having a through-hole in a center thereof for receiving hair in ponytail or the like styles. The annular body is flexible, bendable, and twistable so that the hair styling device can provide a wide variety of hair styles. However, the hair styling device is prone to slip when the users are engaged in athletics or recreational activities, requiring constant readjustments to move the hair styling device back into place or to tighten it. Furthermore, the through-hole of the annular body may not work well for quick and easy receiving both of thin and thick hairs of users.

BRIEF SUMMARY OF THE INVENTION

Therefore, it is an objective of the present invention to overcome the aforementioned shortcoming and deficiency of the prior art by providing a hair retainer that can securely retain a user's hair tuft such as a ponytail when the user is engaged in an athletic or recreational activity while allowing quick and easy receiving both of thin and thick strands of hair.

To achieve the foregoing objective, a hair retainer of the present invention includes an annular body of flexible material. The annular body includes first and second side sections spaced and opposed in a width direction and first and second end portions spaced and opposed in a length direction perpendicular to the width direction. A receiving through-hole is defined by the first and second side sections and the first and second end portions. Two clamping frames extend outwardly from the first and second end portions of the annular body respectively. Each clamping frame includes spaced inner and outer ends, and the inner end of each clamping frame is connected to one of the first and second end portions of the annular body. A plurality of teeth projects from the inner end and extends toward the outer end of each clamping frame. Each of the plurality of teeth is curved such that a hair clipping space is defined between the plurality of teeth and one of the two clamping frames.

In a preferred form, the second end portion of the annular body interconnects the first and second side sections of the annular body. The first end portion extends from an end of the second side section and is detachably engaged with an end of the first side section of the annular body. An upper protrusion with a coupling hole is formed on a free end of the first side section of the annular body, and a lower protrusion with a peg is formed on a free end of the first end portion of the annular body. The first side section of the annular body is moveable relative to the first end portion between an open position and a closed position. An opening is formed between the first end portion and the first side section of the annular body when the first side section is in the open position. The peg of the first end portion is engaged in the coupling hole of the first side section when the first side section is in the closed position.

Preferably, the annular body further includes first and second wings extending outwardly from the first and second end portions respectively and at an acute angle to the length direction. The two clamping frames extend outwardly from the first and second wings of the annular body respectively. The inner end of each clamping frame is integrally connected to one of the first and second wings. Each clamping frame is a hollow rectangular plate with elasticity. Each of the plurality of teeth includes a distal end extending beyond the outer end of one of the two clamping frames.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

DETAILED DESCRIPTION OF THE INVENTION

Figure 1:
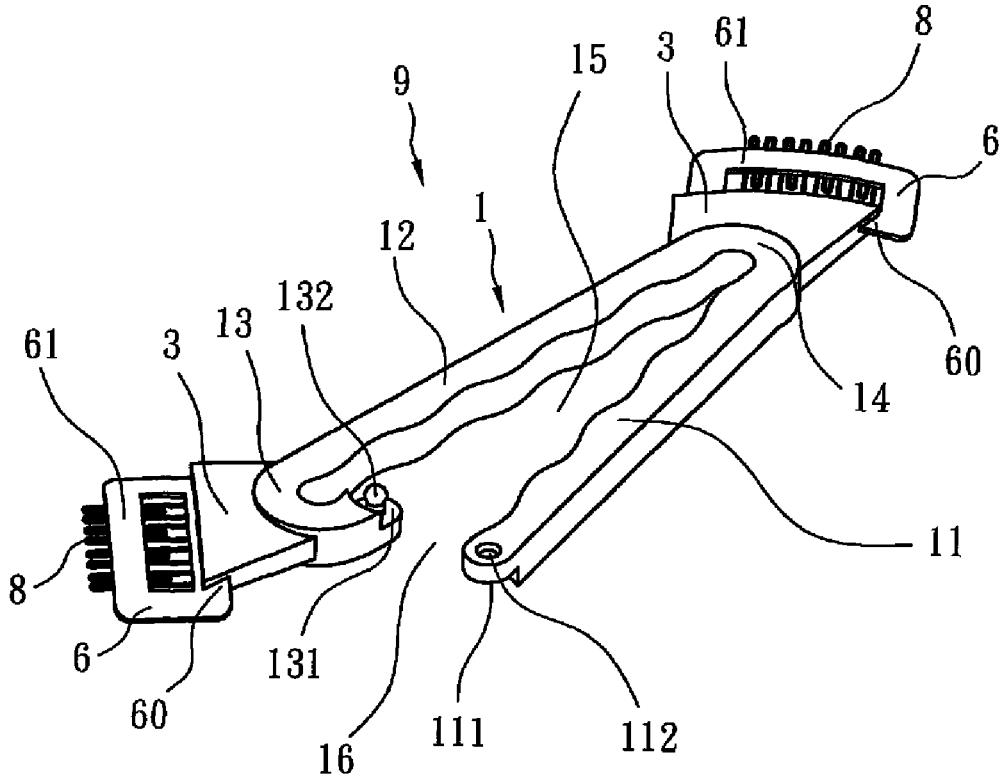
FIG. 1 is a perspective view of a hair retainer according to a first embodiment of the present invention with an annular body of the hair retainer in an open state.
Figure 2:
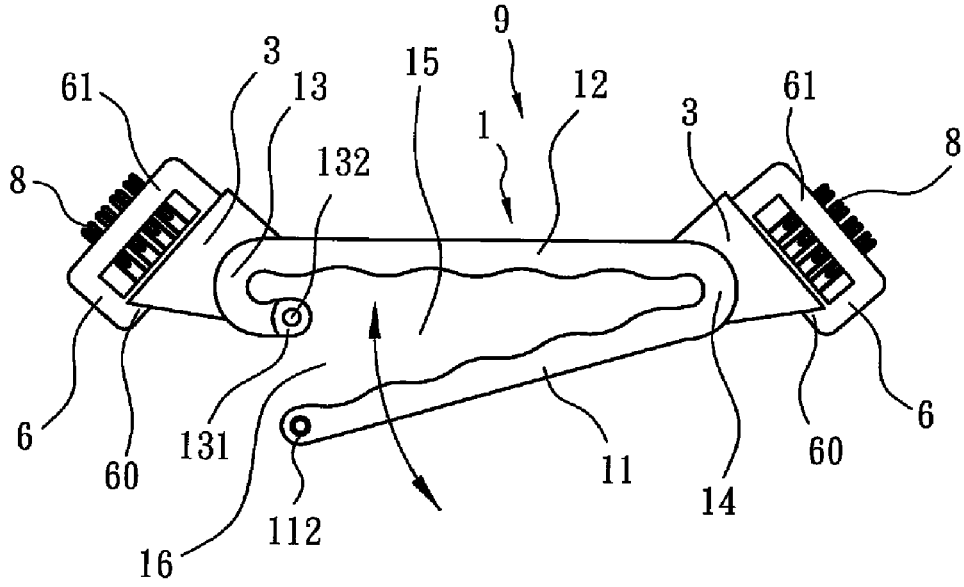
FIG. 2 shows a side view of the hair retainer of FIG. 1.
Figure 3:
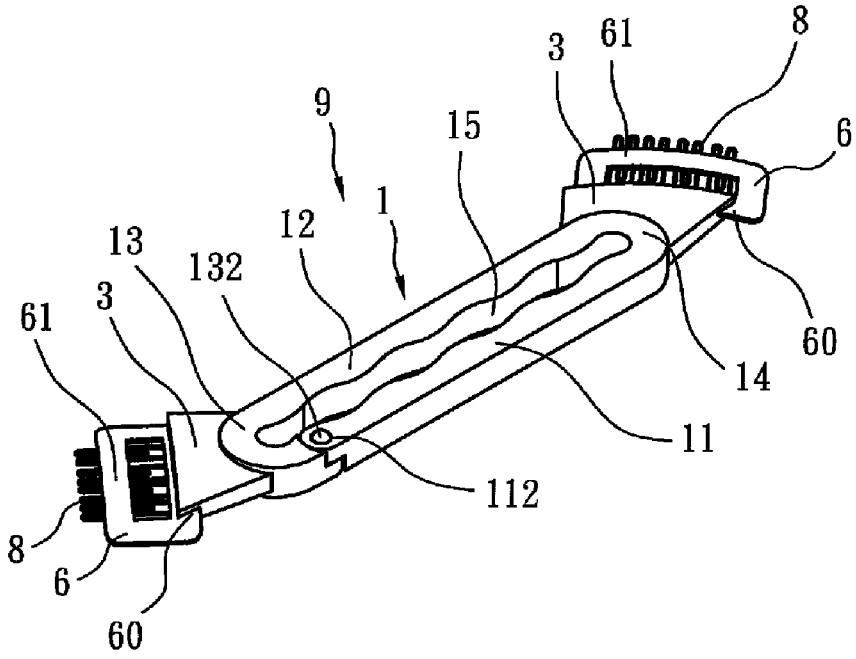
FIG. 3 shows a perspective view of the hair retainer of FIG. 1 with the annular body in a closed state.
Figure 4:
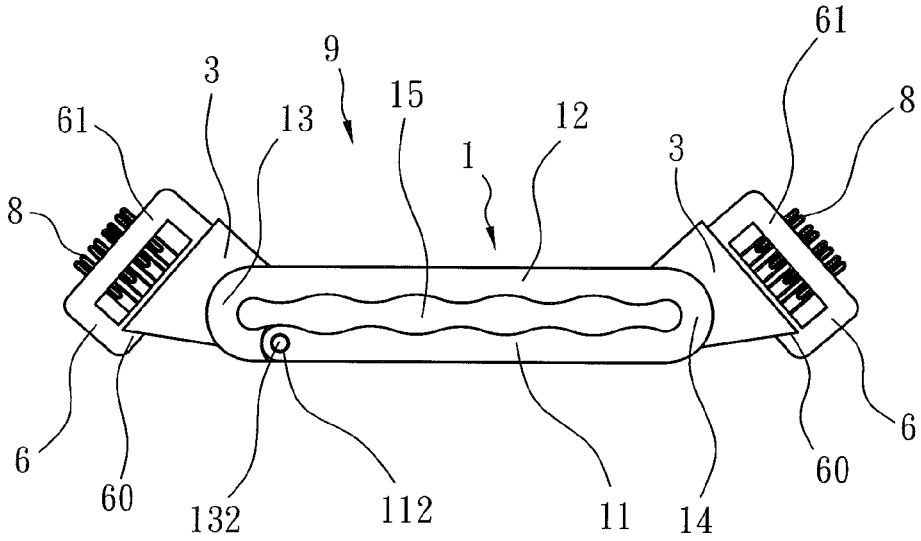
FIG. 4 shows a side view of the hair retainer of FIG. 3.
Figure 5:
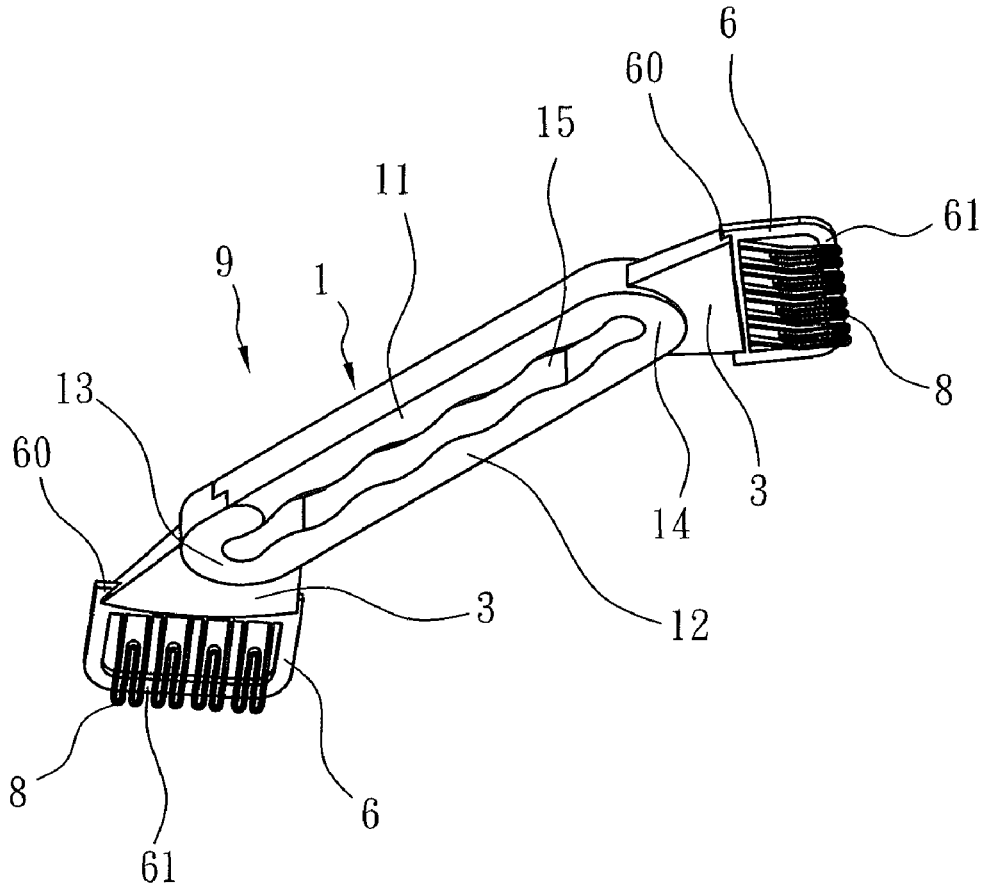
FIG. 5 shows another perspective view of the hair retainer of FIG. 3.
Figure 6:
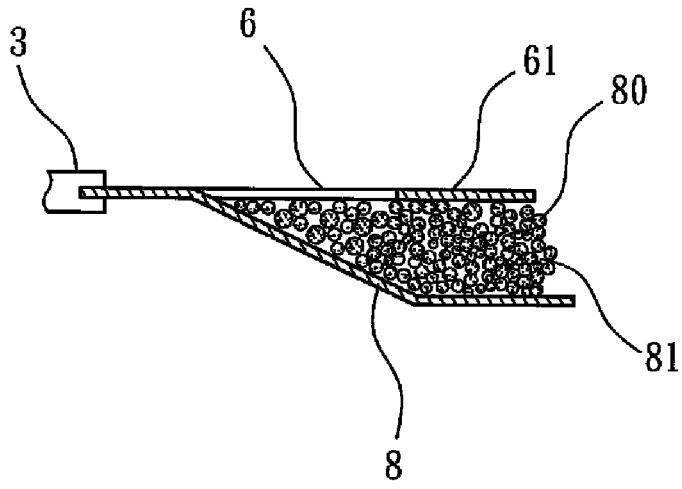
FIG. 6 shows a partial, cross sectional view of the hair retainer of FIG. 1, with a section of hair received between a clamping frame and teeth of the hair retainer.
Figure 7:
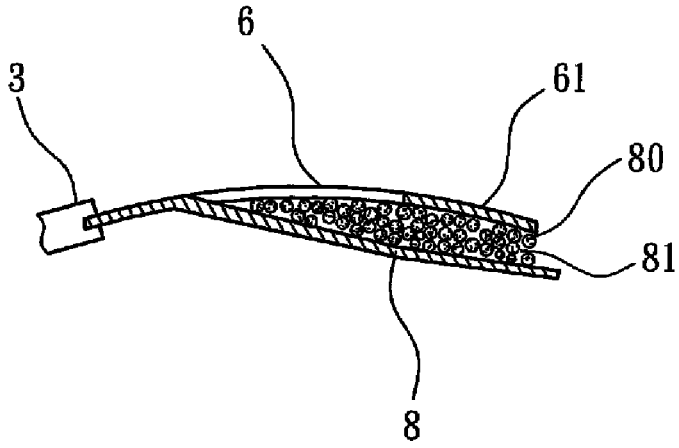
FIG. 7 shows a cross sectional view similar to FIG. 6 with the clamping frame and teeth of the hair retainer moved toward each other.

A hair retainer of a first embodiment of the present invention is shown in FIGS. 1 through 7 of the drawings and generally designated 9. The hair retainer 9 includes an annular body 1 and two clamping frames 6. The hair retainer 9 can be used as a hair styling accessory for styling and retaining a hair tuft such as a ponytail of a user.

Figure 8:
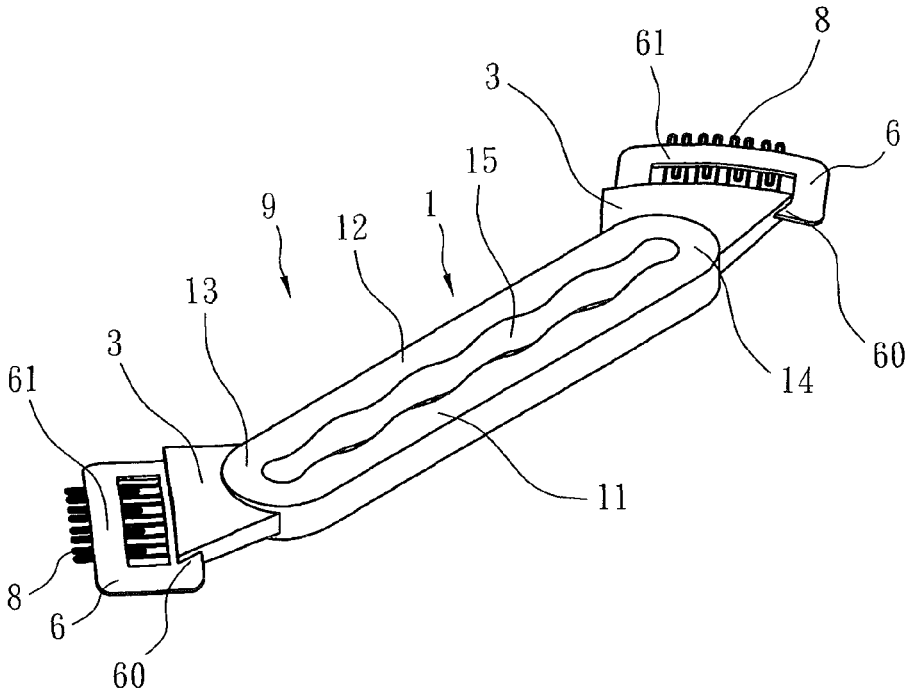
FIG. 8 is a perspective view of a hair retainer according to a second embodiment of the present invention.

According to the preferred form shown, the annular body 1 is made of a flexible, deformable plastic material so that the annular body 1 can be bent or twisted without breaking. The annular body 1 includes straight first and second side sections 11 and 12 spaced and opposed in a width direction. The annular body 1 further includes rounded first and second end portions 13 and 14 spaced and opposed in a length direction perpendicular to the width direction. Each of first and second side sections 11 and 12 has a length in the length direction greater than that of each of first and second end portions 13 and 14. A receiving through-hole 15 is defined by the first and second side sections 11 and 12 and the first and second end portions 13 and 14. In this embodiment, the second end portion 14 interconnects the first and second side sections 11 and 12, while the first end portion 14 extends from an end of the second side section 12 and detachably engaged with an end of the first side section 11. In another embodiment (see FIG. 8), the first and second end portions 13 and 14 respectively interconnect the first and second side sections 11 and 12 so that the annular body 1 is in the form of a continuous, rectangular frame with the receiving through-hole 15 therein.

According to the preferred form shown, an upper protrusion 111 with a coupling hole 112 is formed on a free end of the first side section 11 of the annular body 1, and a lower protrusion 131 with a peg 132 is formed on a free end of the first end portion 13 of the annular body 1. The first side section 11 is moveable relative to the first end portion 13 between an open position and a closed position. When the first side section 11 is in the open position, the annular body 1 is in an open state with an opening 16 formed between the first end portion 13 and the first side section 11 of the annular body 1 (see FIG. 2), allowing hair of a user to be quickly and easily placed into the annular body 1 through the opening 16. When the first side section 11 is in the closed position, the annular body 1 is in a closed state with the peg 132 of the first end portion 13 engaged in coupling hole 112 of the first side section 11 (see FIG. 4), allowing the hair of the user to be received and enclosed in the annular body 1. Further, the annular body 1 further includes first and second wings 3 extending outwardly from the first and second end portions 13 and 14 respectively and at an acute angle to the length direction.

The two clamping frames 6 are extended outwardly from the first and second wings 3 respectively. According to the preferred form shown, each clamping frame 6 is a hollow rectangular plate with elasticity and includes spaced inner and outer ends 60 and 61. The inner end 60 of each clamping frame 6 is integrally connected to one of the first and second wings 3. The hair retainer 9 further includes a plurality of teeth 8 projecting from the inner end 60 and extending toward the outer end 61 of each clamping frame 6. Each tooth 8 includes a distal end extending beyond the outer end 61 of an associated clamping frame 6. Each tooth 8 is curved such that a hair clipping space 81 is defined between the teeth 8 and one of the two clamping frames 6 for receiving a section of hair 80 of a user (see FIG. 6). Further, each clamping frame 6 is sufficiently flexible or elastic to be deformed by pressing of the user and then apply a constricting tension to retain the section of hair 80 in hair clipping space 81 (see FIG. 7). Specifically, the user can move the clamping frames 6 and teeth 8 of the hair retainer 9 toward each other for clipping the hair 80, or move the clamping frames 6 and teeth 8 away from each other to allow releasing of the hair 80.

Figure 9:
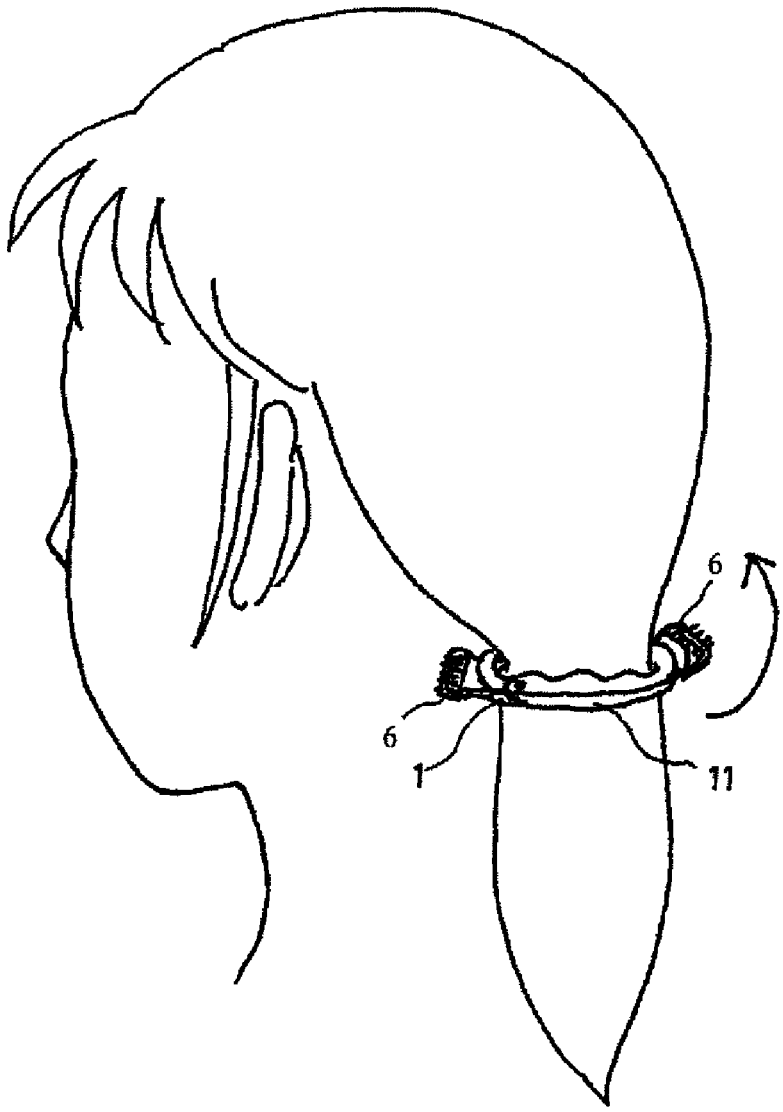
FIG. 9 shows a schematic view illustrating a ponytail of a user extending through a receiving through-hole of the annular body of the hair retainer of FIG. 1.
Figure 10:
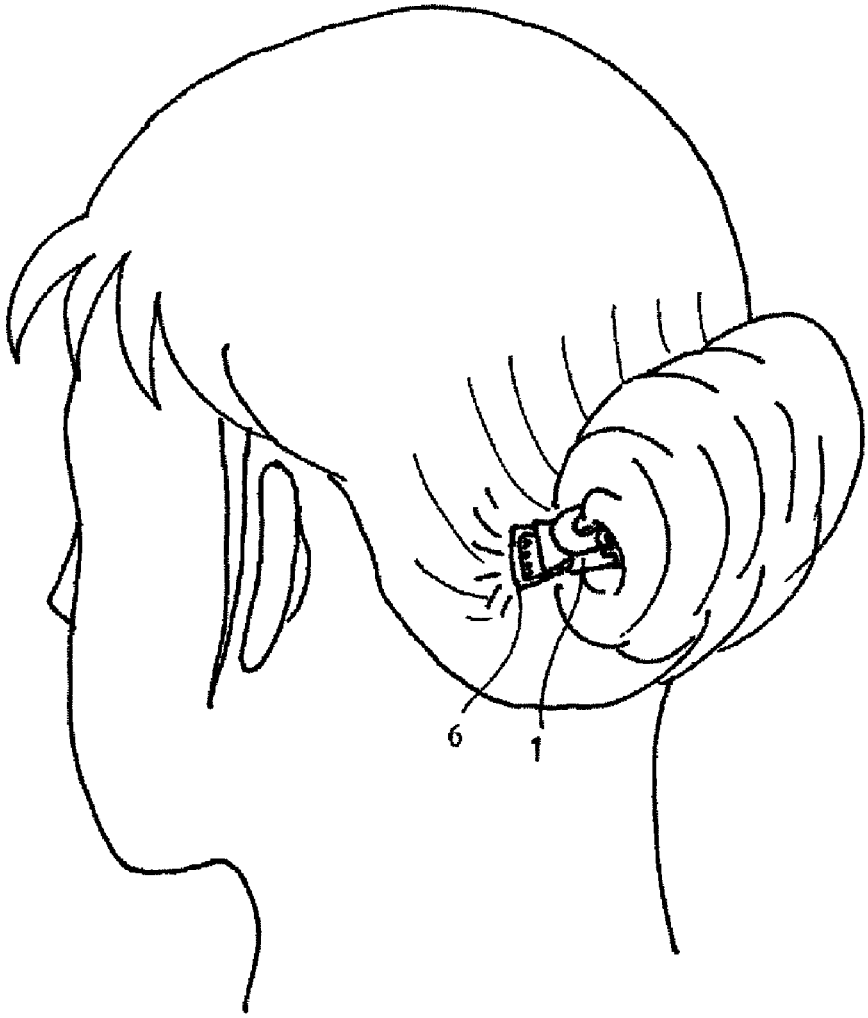
FIG. 10 shows a schematic view similar to FIG. 9 illustrating a hair style created by the hair retainer of the present invention.

FIGS. 9 and 10 illustrate the hair retainer 9 in use holding a ponytail of a user and creating a particular hair style. First, the ponytail is placed within the receiving through-hole 15 of the annular body 1 (FIG. 9). The next step is to roll the annular body 1 or the ponytail to form a bun on the back of the head or the nape of the neck of the user, and, then, the annular body 1 is bent and/or twisted to hold the bun in place. After the ponytail is formed into a bun form and properly restrained by the annular body 1, the clamping frames 6 is secured within the section of hair 80 near the base of the bun with hair 80 retained in the hair clipping space 81 between each clamping frame 6 and teeth 8, ensuring that the hair retainer 9 will remain secure without requiring frequent readjustments during athletics or recreational activities.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A hair retainer comprising:

an annular body of flexible material, with the annular body including first and second side sections spaced and opposed in a width direction, with the annular body further including first and second end portions spaced and opposed in a length direction perpendicular to the width direction, with a receiving through-hole defined by the first and second side section and the first and second end portions;

first and second wings extending outwardly from the first and second end portions respectively and at an acute angle to the length direction, two clamping frames extending outwardly from the first and second wings, each clamping frame including spaced inner and outer ends, the inner end of each clamping frame being integrally connected to one of the first and second wings; and a plurality of curved teeth projecting from the inner end and extending toward the outer end of each clamping frame, with a hair clipping space is defined between the plurality of teeth and one of the clamping frames for clipping a section of hair of a user.

2. The hair retainer according to claim 1, with the second end portion of the annular body interconnecting the first and second side sections of the annular body, with the first end portion extending from an end of the second side section and detachably engaged with an end of the first side section of the annular body, with an upper protrusion formed on a free end of the first side section of the annular body and having a coupling hole, with a lower protrusion formed on a free end of the first end portion of the annular body and having a peg, with the first side section being moveable relative to the first end portion between an open position and a closed position, with an opening formed between the first end portion and the first side section of the annular body when the first side section is in the open position, and with the peg of the first end portion engaged in the coupling hole of the first side section when the first side section is in the closed position.

3. The hair retainer according to claim 1, with each clamping frame being a hollow rectangular plate with elasticity, and with each of the plurality of teeth including a distal end extending beyond the outer end of one of the clamping frames.

* * * * *